US007655883B2

(12) United States Patent
Heise

(10) Patent No.: US 7,655,883 B2
(45) Date of Patent: Feb. 2, 2010

(54) HEATED PLUMBING VENT

(75) Inventor: Lorne R. Heise, Ontario (CA)

(73) Assignee: Heat-Line Corporation, Carnarvon (CA)

( * ) Notice: Subject to any disclaimer, the term of this patent is extended or adjusted under 35 U.S.C. 154(b) by 213 days.

(21) Appl. No.: 11/105,445

(22) Filed: Apr. 14, 2005

(65) Prior Publication Data

US 2006/0057950 A1 Mar. 16, 2006

Related U.S. Application Data

(60) Provisional application No. 60/609,277, filed on Sep. 14, 2004.

(51) Int. Cl.
*H05B 1/00* (2006.01)

(52) U.S. Cl. ..... 219/213; 4/219; 454/43

(58) Field of Classification Search ..... 4/218; 138/33; 52/199, 219; 219/213; 454/4, 41, 454/43, 367, 368

See application file for complete search history.

(56) References Cited

U.S. PATENT DOCUMENTS 3,378,673 A * 4/1968 Hopper ..... 392/472
4,423,311 A 12/1983 Varney, Sr.
4,429,213 A 1/1984 Mathieu
4,442,643 A 4/1984 Stadheim
4,524,262 A 6/1985 Meyer
4,974,632 A * 12/1990 Ericson ..... 4/218 X
5,129,387 A 7/1992 Behrens
5,538,043 A * 7/1996 Salazar ..... 138/26
6,097,008 A 8/2000 Mahin
6,196,272 B1 3/2001 Davis et al.
2003/0079787 A1 5/2003 Heise
2005/0115625 A1 6/2005 White

* cited by examiner

*Primary Examiner*—Robert M Fetsuga
(74) *Attorney, Agent, or Firm*—John R. S. Orange; Blake, Cassels & Graydon LLP

(57) ABSTRACT

A heated vent cap assembly is provided which can be coupled to a pipe originating from a plumbing system within a building. A heating element is wound around an inner cylinder which is wrapped in a conductive foil and enveloped by a larger diameter outer cylinder which is lined with a reflective foil defining a void there between. The cylinders are secured at an upper end by an end cap and at a lower end by a lower end cap and a tether is tautly secured within the inner cylinder by a bridge in an opening of the end cap and a lower disk engaged with the lower end of the inner cylinder to support ice blocks formed therein. The heating cable generates heat, which is reflected by the reflective foil and absorbed by the conductive foil to prevent ice from forming on the inner surface of the inner cylinder.

19 Claims, 9 Drawing Sheets

HEATED PLUMBING VENT

This application claims priority from United States Provisional Patent Application No. 60/609,277 filed on Sep. 14, 2004.

FIELD OF THE INVENTION

The present invention relates to a vent used to vent sewer gas and the like.

DESCRIPTION OF THE PRIOR ART

A plumbing system typically includes a water supply system to transfer water from a water main to appliances within a house and a waste water system to carry waste products to a sewer or other disposal system. The waste water system includes a vent pipe to vent gaseous products and water vapour to the outside of a building. The gaseous products can be sewer gases or other unpleasant fumes that may be noxious or hazardous if allowed to back up within the building.

It is well known to incorporate a vent pipe into a building by extending a pipe, made of a material such as acrylonitrile butadiene styrene (ABS) or polyvinyl chloride (PVC), from the waste water system to the exterior of the building. In sub-freezing temperatures such as those typically encountered in northern climates, the water vapour that escapes the ventilation pipe may condense when contacting the colder outside air, and begin to freeze against the inner wall of the ventilation pipe eventually completely blocking the vent pipe. With the vent pipe blocked, the gases cannot escape the plumbing system and may back up into the building.

It is therefore an object of the present invention to provide a plumbing vent which obviates or mitigates at least one of the above mentioned disadvantages.

SUMMARY OF THE INVENTION

According to one aspect of the present invention there is provided a vent cap for connection to a vent pipe of a plumbing system to vent gas to atmosphere. The vent cap has a body defining a passageway for gas and a heating element to supply heat to the passageway and thereby inhibit freezing of water vapour in the passageway.

In one embodiment, the present invention provides a vent cap comprising a pair of nested pipes and secured to one another to define a void therebetween. A heating element is situated within the void and is capable of radiating heat for transfer from the outer surface of the inner pipe to the inner surface of the inner pipe to inhibit freezing of the water vapour in the vent pipe.

Preferably, the vent cap has a cord along its axis to retain ice axially and as a further preference a bridge is extended across a lower end of said inner pipe to inhibit downward movement of a mass of ice.

As a further preference the heating element is an electric heating element. In another embodiment the heating element is a fluid conduit that passes heated fluid through the void.

To facilitate heat transfer in to the inner pipe, a metal foil is wrapped about the outer surface of the inner pipe within the void and a reflective foil is placed around the inner wall of the outer pipe.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
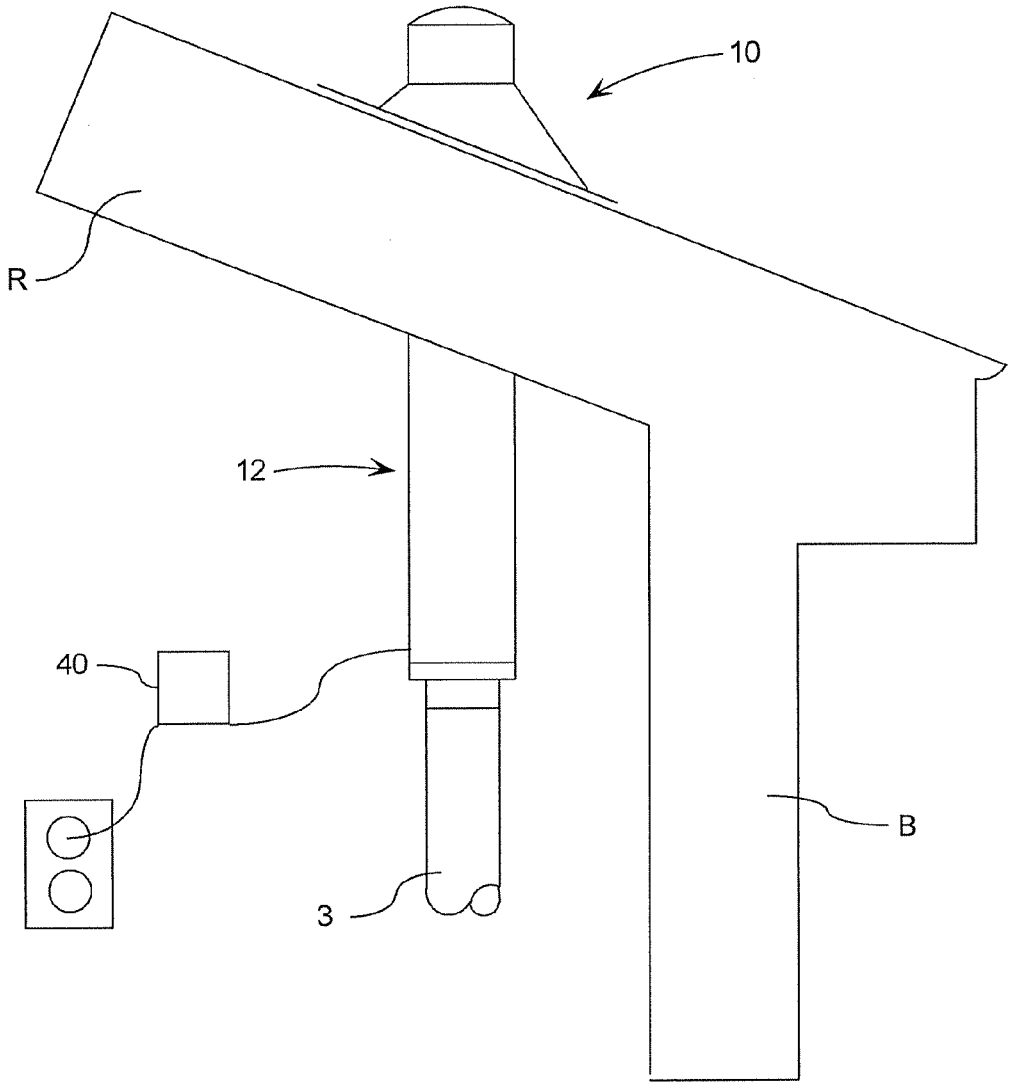
FIG. 1 is a cross-sectional view of a vent installed on a building.

Referring therefore to FIG. 1, a building B has a roof R. A vent pipe installation 2 of a plumbing system (not shown) protrudes through the roof R of the building B. The vent pipe installation 2 includes a pipe 3 connected to the waste water system and a vent cap assembly 10 which extends through the roof R. The vent pipe 3 is typically an ABS pipe, however it may also use other materials. The vent pipe 3 is required to vent gas, such as methane, from the waste water system to the atmosphere.

Figure 2:
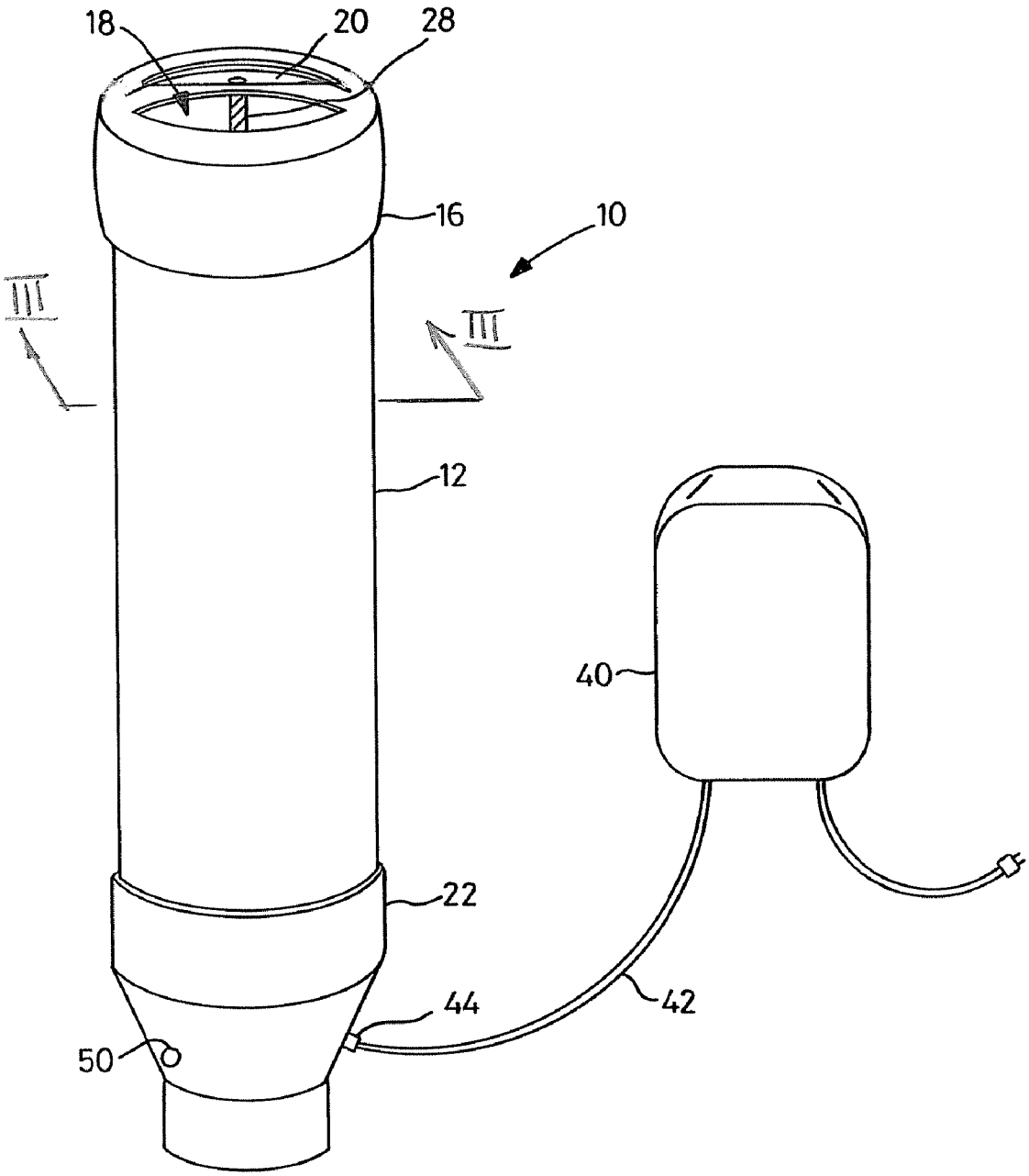
FIG. 2 is a perspective view of the vent of FIG. 1.
Figure 3:
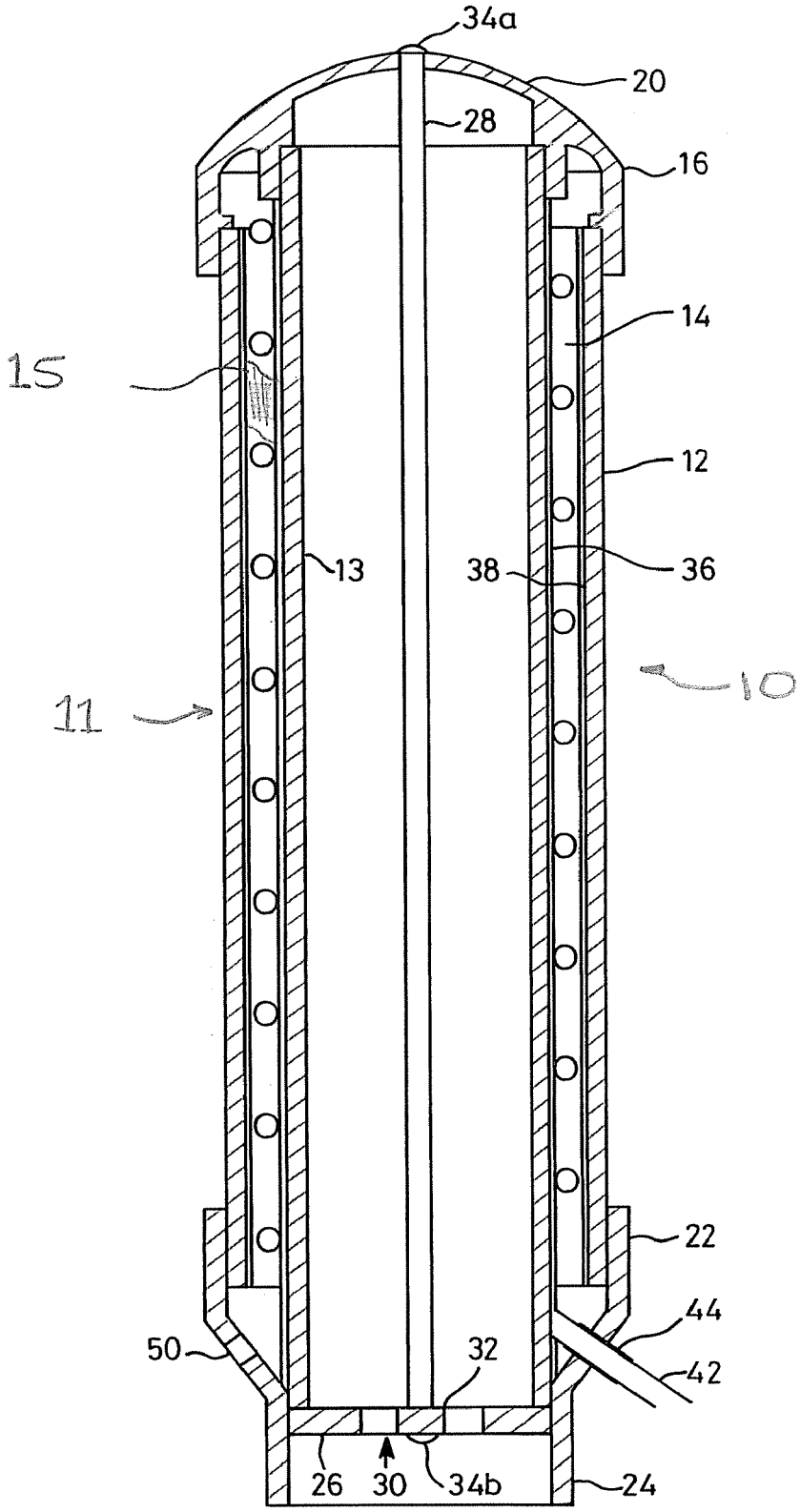
FIG. 3 is a cross-sectional view of the vent along the line III-III of FIG. 2.

The details of the vent cap assembly 10 is shown in FIGS. 2 and 3. The vent cap assembly 10 has a cylindrical body 11 formed by an outer cylinder 12 and an inner cylinder 13. The cylinders 12, 13 are generally concentric and dimensioned to provide an annular void 14 between them.

One end of the void 14 is sealed by an end cap 16 extending between the outer cylinder 12 and the inner cylinder 13. The end cap 16 has a central opening 18 coinciding with the inner diameter of the inner cylinder 13 with a bridge 20 extending across the opening 18.

The opposite end of the body 11 is sealed by a lower end cap 22 which extends between the outer cylinder 12 and inner cylinder 13 and projects downwardly from the inner cylinder 13 to provide a skirt 24 for coupling to the vent pipe 3.

An internal tether 28 is attached to the cap 16 at the bridge 20. The tether 28 extends along the axis of the inner cylinder 13 and is secured to a retaining disc 26 at its lower end. The disc 26 abuts the lower end of the inner cylinder 13 within the skirt 24 and has a central opening 30 with a bridge 32 extending across a diameter.

A heating element 42 is located in the void 14. In the embodiment shown in FIGS. 2 and 3, the heating element 42 is a self regulating electric heating element 42, such as that available from Heat-Line Corporation, Canarvon, Ontario under the trademark Paladin I. The heating element 42 is wrapped spirally about the inner cylinder 13 and exits the void 14 through a strain relief aperture 44 in the lower end cap 22. The cable 42 is connected to a power source, typically an electrical outlet in the building.

A layer of heat conducting foil 36 is wrapped on the outer surface of the inner cylinder 13 from the lower end to the upper end and serves to distribute the heat generated by cable 42 uniformly into the wall of the inner cylinder 13. A liner of reflective foil 38 is also affixed to the interior surface of the outer cylinder 12 to inhibit heat transfer through the outer wall. The void 14 is vented to the atmosphere by a hole 50 in the lower end cap 22 to maintain the void 14 at an equal pressure to the interior of the building B.

Figure 4:
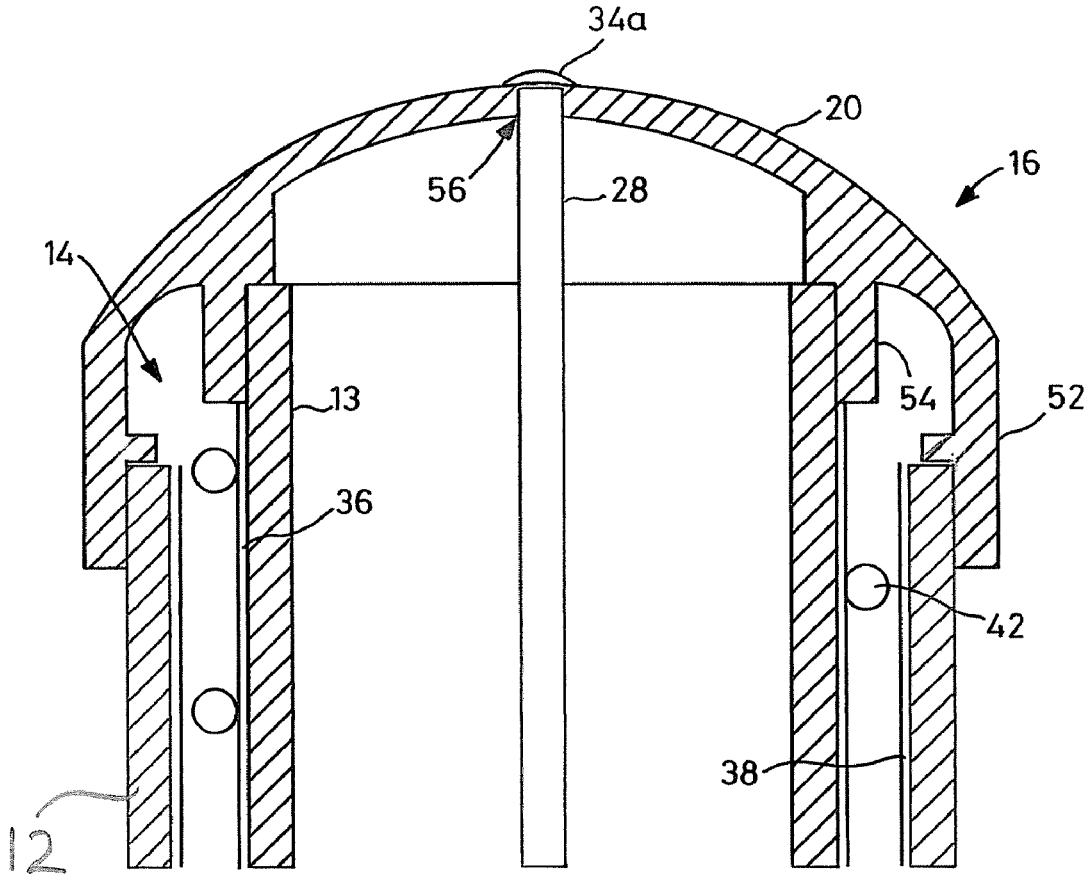
FIG. 4 is a partial enlarged view of the cap shown in FIG. 2.
Figure 5:
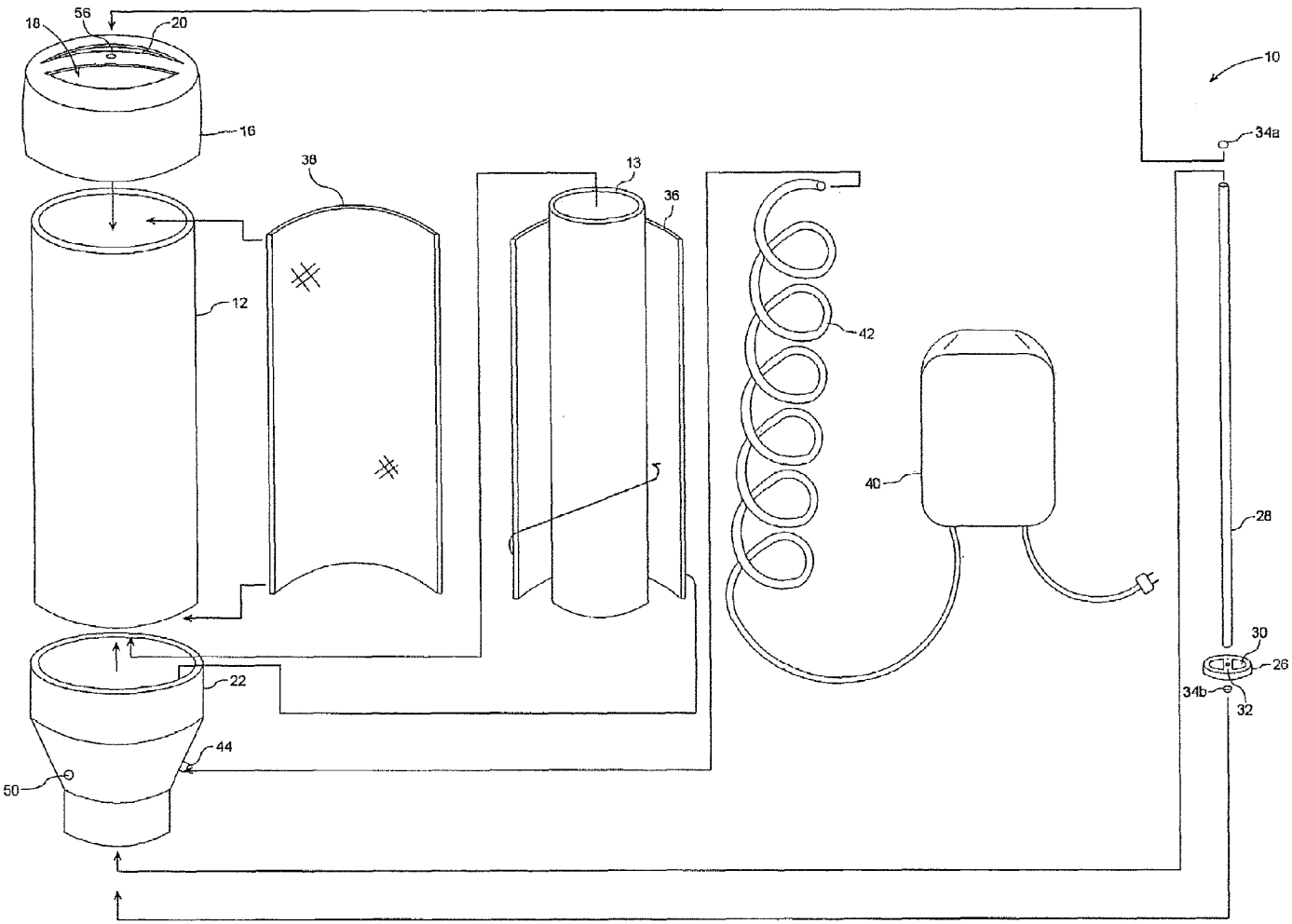
FIG. 5 is an exploded view of FIG. 2 illustrating the assembly of the heated vent.

An enlarged view of the cap 16 is shown in FIG. 4. The cap 16 has an outer sleeve 52, an inner sleeve 54 and a hole 56 for the tether 28 to pass through for fastening. The outer sleeve 52 overlies the wall of the outer cylinder 12 to allow the outer cylinder 12 to be secured to the cap 16 and the inner sleeve 54 is offset from the outer sleeve 52 such that the smaller diameter inner cylinder 13 can also be secured to the cap 16. The sleeves 52, 54 are separated such that the void 14 extends to the upper end of the inner cylinder 13. The extension of the void 14 allows the heat emanating from the heating element 42 to rise towards the end cap 16, thereby completely surrounding the inner cylinder 13. This allows the entire length of the inner cylinder 13 to be heated, including the portion secured within the end cap 16.

In an exemplary method for assembling the vent cap assembly 10, the outer cylinder 12 is lined with the reflective foil 38 (if applicable) and the inner cylinder 13 is wrapped in the conducting foil 36 (also if applicable). The heating element 42 is then fed through the strain relief aperture 44 in the lower end cap 22.

With the majority of the length of the heating element 42 fed through the strain relief aperture 44, the heating element 42 is wrapped around the foil-wrapped inner cylinder 13 in a substantially helical pattern to distribute the heat along the entire exposed outer surface of the inner cylinder 13. (e.g. the length of the inner cylinder 13 which is not secured within the end cap 16 nor the lower end cap 22) The heating element 42 is pre-wound into a spiral of slightly smaller diameter than the inner cylinder so that as it wrapped about the cylinder, the memory retains the cable in situ. The end of the cable may then be secured with tape. With this arrangement, the lower end of the inner cylinder 13 can be secured to the lower end cap 22 using a suitable adhesive such as PVC cement or by sonic or thermal welding in automated production. The remaining length of the heating element 42 is then pulled back through the aperture 44 and the strain relief is secured.

The foil-lined outer cylinder 12 can then be slid over the inner cylinder 13 and secured to the larger diameter end of the lower end cap 22 using a suitable adhesive such as PVC cement. The tether 28 can now be fed through the lower disk 26 and subsequently through the lower end cap 22. The lower end of the tether 28 can then be fastened to the bridge 32 of the lower disk 26 using a suitable fastener 34*b*. The lower disk 26 can optionally be secured to the lower end of the inner cylinder 13 in which it engages the end of the inner cylinder 13 using a suitable adhesive. The unfastened end of the tether 28 can then be fed through the inner cylinder 13 and subsequently through the hole 56 in the end cap 16. The end cap 16 can then be secured to the upper ends of both the inner cylinder 13 and the outer cylinder 12 using a suitable adhesive such as PVC cement. When secured, the inner sleeve 54 of the end cap 16 will be affixed to an uppermost portion of the inner cylinder 13 and the outer sleeve 52 of the end cap 16 will be affixed to an uppermost portion of the outer cylinder 12 as shown in FIG. 4.

The tether 28 can now be pulled through the hole 56 until reasonably taut and suitably trimmed and fastened to the bridge 20 of the end cap 16 using a suitable fastener 34*a*. Once assembled, the vent cap assembly 10 can be coupled with the existing pipe 3 by securing the pipe 3 to the inner wall of the skirt 24 while inserting the uppermost end of the pipe 3 into the skirt 24. The uppermost end of the pipe 3 is preferably in engagement with the lower disk 26 thereby sealing the pipe 3 to the vent cap assembly 10. The pipe 3 can be secured to the skirt 24 using a suitable adhesive such as a PVC to ABS transition cement or any other adhesive appropriate to the materials used.

It is preferable to have the void 14 completely sealed from the pipe 3 to avoid the heating element 42 from igniting any potentially volatile gases escaping from the plumbing system. During assembly, the void 14 may also be filled with an insulating material 15 if desired to provide further insulation surrounding the inner cylinder 13. Any suitable insulating material 15 such as fibreglass mat or urethane foam can be used. The void 14 would be filled with the insulating material 15 after the inner cylinder 13 has been enveloped by the outer cylinder 12 and the other elements internal to the void 14 (e.g. foils and heating element) are present within the void 14.

In use therefore, the vent cap assembly 10 is coupled to the pipe 3 as shown in FIG. 2. When the heating element 42 has not been energized, the gases originating from the plumbing system and travelling through the pipe 3 will proceed through the vent cap assembly 10 as usual. The openings in both the lower disk 26 and the end cap 16 allow the gases to pass through to the exterior of the building B. If the ambient temperature in the exterior of the building B is below freezing, the gases (which tend to typically contain moisture) may begin to condense at the interface of the inner cylinder 13 and the exterior of the building B when confronted with colder air. This condensation will then tend to freeze towards the centre of the opening 18 creating an ice blockage as the ice builds up.

Figure 6:
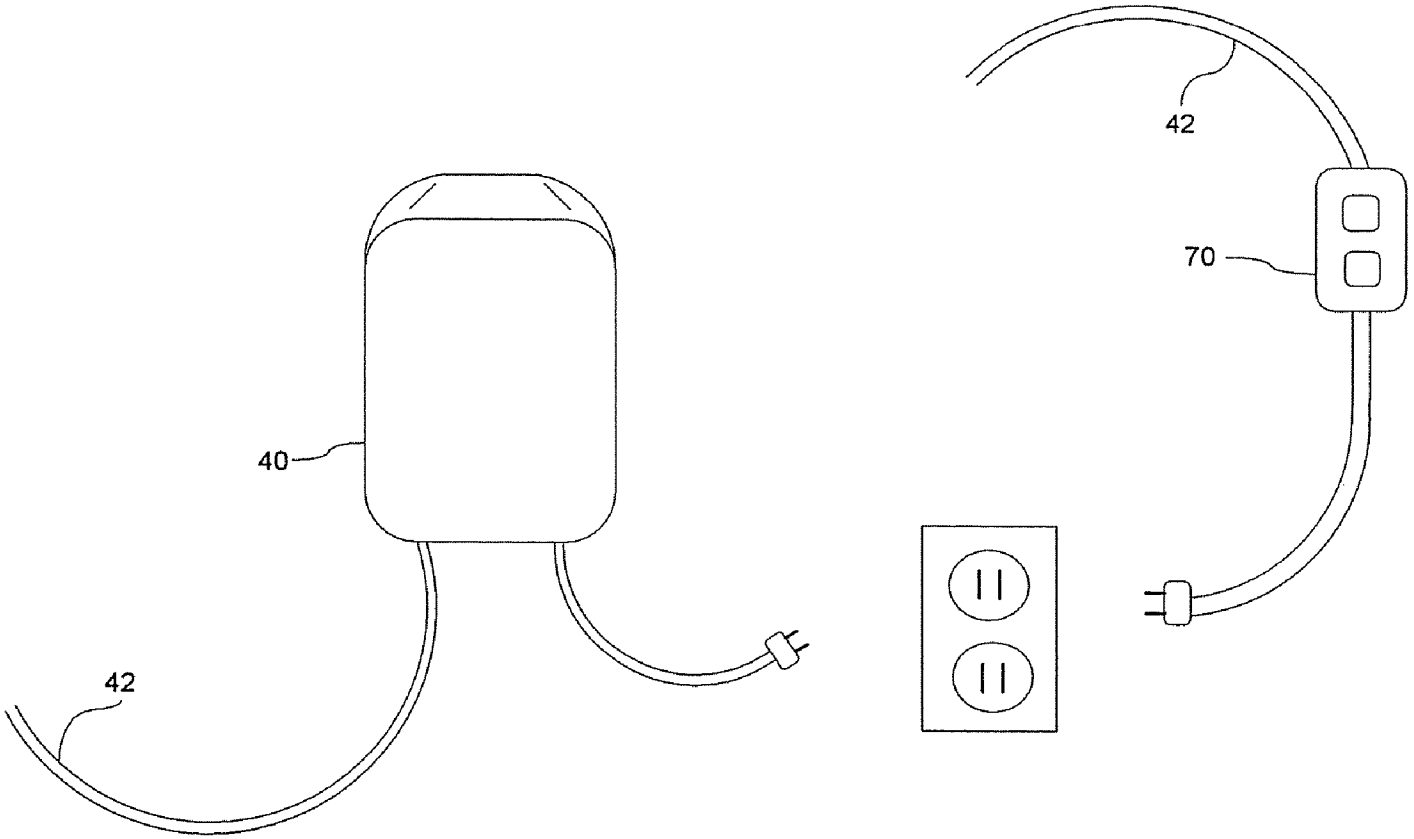
FIG. 6 is a schematic view of alternative heating element controls.

To remove the blockage, the heat element 42 is connected to an electrical power outlet. If a self-regulating heating element is utilised, the drop in ambient temperature will cause the heating effect to increase and the supply of energy will be automatically controlled. Alternatively, where a conventional heating element is used, the heating element 42 may utilise a separate control 40 to regulate the energy supply or incorporate a single pole switch 70 as shown in FIG. 6. This single-pole switch 70 allows the heating element 42 to be turned "on" or "off" manually without using any self-regulating controls.

When energised, the heating element 42 generates heat which is simultaneously absorbed by the conductive foil 36 and reflected by the reflective foil 38 to distribute the heat in a substantially even manner over the outer surface of the inner cylinder 13. The inner cylinder 13 will transfer this heat due to its conductive properties from its outer surface to its inner surface thereby applying heat to any ice which has formed along its inner surface. It should be noted that the heat is preferably transferred while having the heating element 42 sealed from the interior of the inner cylinder 13 for safety purposes if the gases are potentially volatile.

The ice will tend to melt inwards towards the tether 28 since it is being heated through the inner cylinder 13 and the tether 28 will support the ice from falling within the inner cylinder 13 and creating unpleasant noise or the ice blockage from being lodged in an elbow of the unheated part of the plumbing system. The lower disk 26 also prevents any large pieces of ice, which may fall through the vent cap assembly 10 from entering the unheated pipe 2. Some of the heat radiated by the heating element 42 will rise and concentrate within the uppermost portion of the void 14, which lies within the end cap 16. This portion of the void 14 will transfer heat through the inner sleeve 54 and the uppermost portion of the inner cylinder 13 to melt any ice forming the uppermost portion of the inner surface of the inner cylinder 13.

The heated vent 10 cap assembly may continuously operate to prevent ice blockage by maintaining a desired temperature along the inner surface of the inner pipe. This can be accomplished using a self-regulating heat source and ultimately prevents any gases from backing up by providing a continuously free passage. Alternatively, to conserve power, the vent cap assembly 10 may be de-energized when ice blockage would likely not occur and be re-energized in anticipation of cold weather.

Where a self-regulating heat source is used, which has the characteristic of varying the heat output based on the ambient temperature, if the ambient temperature rises, the heat output is decreased and conversely if the ambient temperature lowers, the heat output is increased.

It will be appreciated that the conducting foil 36 and reflective foil 38 are preferable but optional features. It will also be appreciated that the inner cylinder 13, outer cylinder 12, end cap 16 and lower end cap 22 can be constructed using any material and can be of any suitable diameter which will satisfy the relative proportions defined herein. Although ABS is commonly used for these elements, they may also be constructed using a polycarbonate material, which exhibits good impact resistance in cold weather as well as good thermal conductivity.

Figure 7:
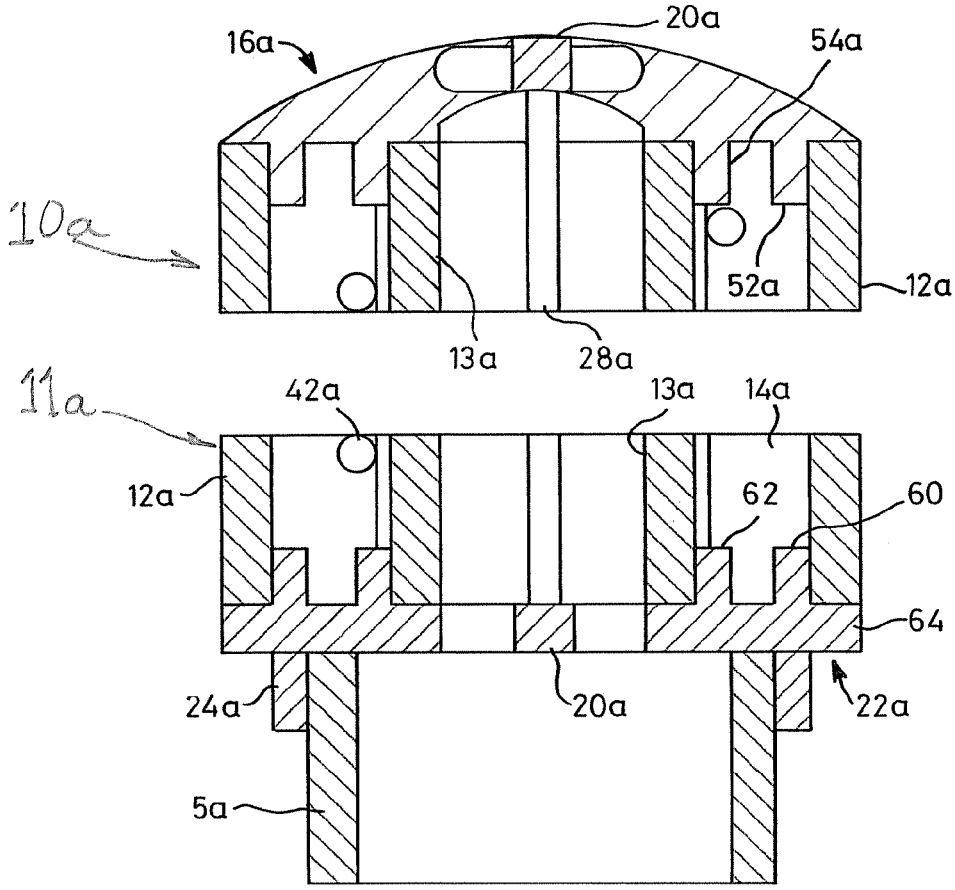
FIG. 7 is a sectional view similar to FIG. 3 of an alternative embodiment of vent.
Figure 8:
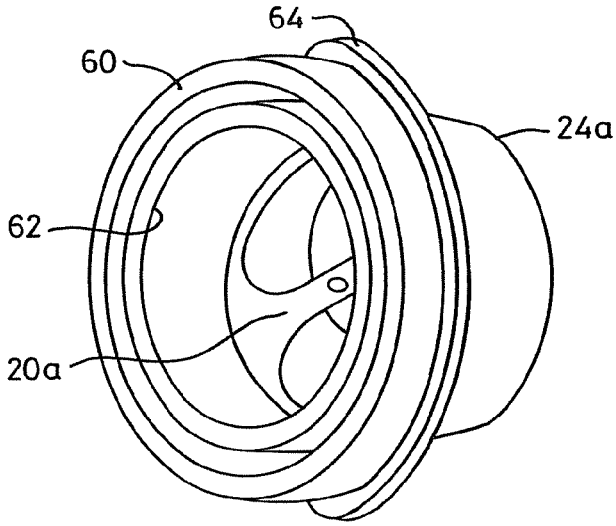
FIG. 8 is a perspective view of a component used in the embodiment of FIG. 7.

An alternative embodiment is shown in FIGS. 7 and 8 which like components will be identified with like reference numerals with a suffix 'a' added for clarity. Referring therefore to FIGS. 7 and 8, the vent cap assembly 10*a* has a cylindrical body 11*a* defined by an outer cylinder 12*a* and an inner cylinder 13*a*. The cylinders 12*a*, 13*a* are of equal length with end caps 16*a*, 22*a* configured to seal the void 14*a* between the cylinders 12*a*, 13*a*. In this regard, the outer sleeve 52*a* is dimensioned to fit within the outer cylinder 12*a* and similarly the lower cap 22*a* has a pair of upstanding walls 60, 62 with a flange 64 projecting radially from the outer wall 60. The cylindrical body 12*a* extends over the wall 60 and abuts the flange 64 with the cylindrical body 13*a* extending inside the wall 62. Each of the end caps 16*a*, 22*a* include bridges 20*a* that receive a tether 28*a*.

The provision of the end cap 16*a*, 22*a* not only facilitates the manufacturer of the vent assembly 10*a* by enabling the bodies 12*a*, 13*a* to be of the same length, but also provides a smooth exterior surface that facilitates installation of the vent cap assembly through the conventional rubber sealing boot. The void 14*a* contains the heating element 42*a* and insulation as described above with respect to the embodiment of FIGS. 1 through 6.

It will be appreciated that the heating element 42 may include any medium capable of conducting heat and an electric heating element herein described was used for illustrative purposes only.

Figure 9:
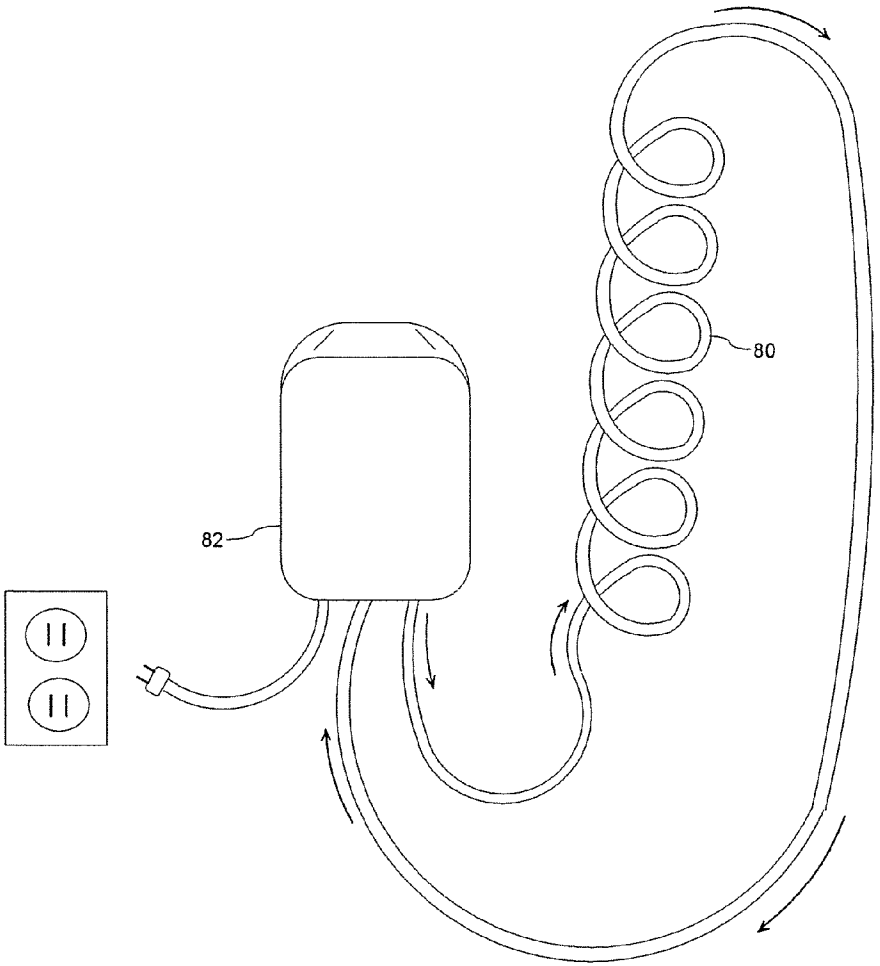
FIG. 9 is a schematic view of a hydronic heating system as an alternative to the heating element shown in FIG. 5, and, FIG. 10 is a sectional view of an alternative embodiment of the vent shown in FIG. 9.

In an alternative embodiment, a hydronic heating element 80 shown in FIG. 9 may be also be used. The hydronic heating element 80 uses glycol heated by a boiler 82 which is fed through the hydronic cable 80, constructed as a small bore tube in a continuous loop. The cable 80 is installed within the void 14 and supplied with heated fluid through the end cap 22. The use of the hydronic heating element may be more suitable where a ready source of heat is available or where electricity supply is limited, and may operate upon a thermo siphon where there is no electrical supply.

The hydronic heating element also has the advantage of not being a potential source of ignition for sewer gas. As such, where fitting a replacement vent is not practical, a hydronic unit may be utilised in an existing vent pipe as shown in FIG. 10.

Figure 10:
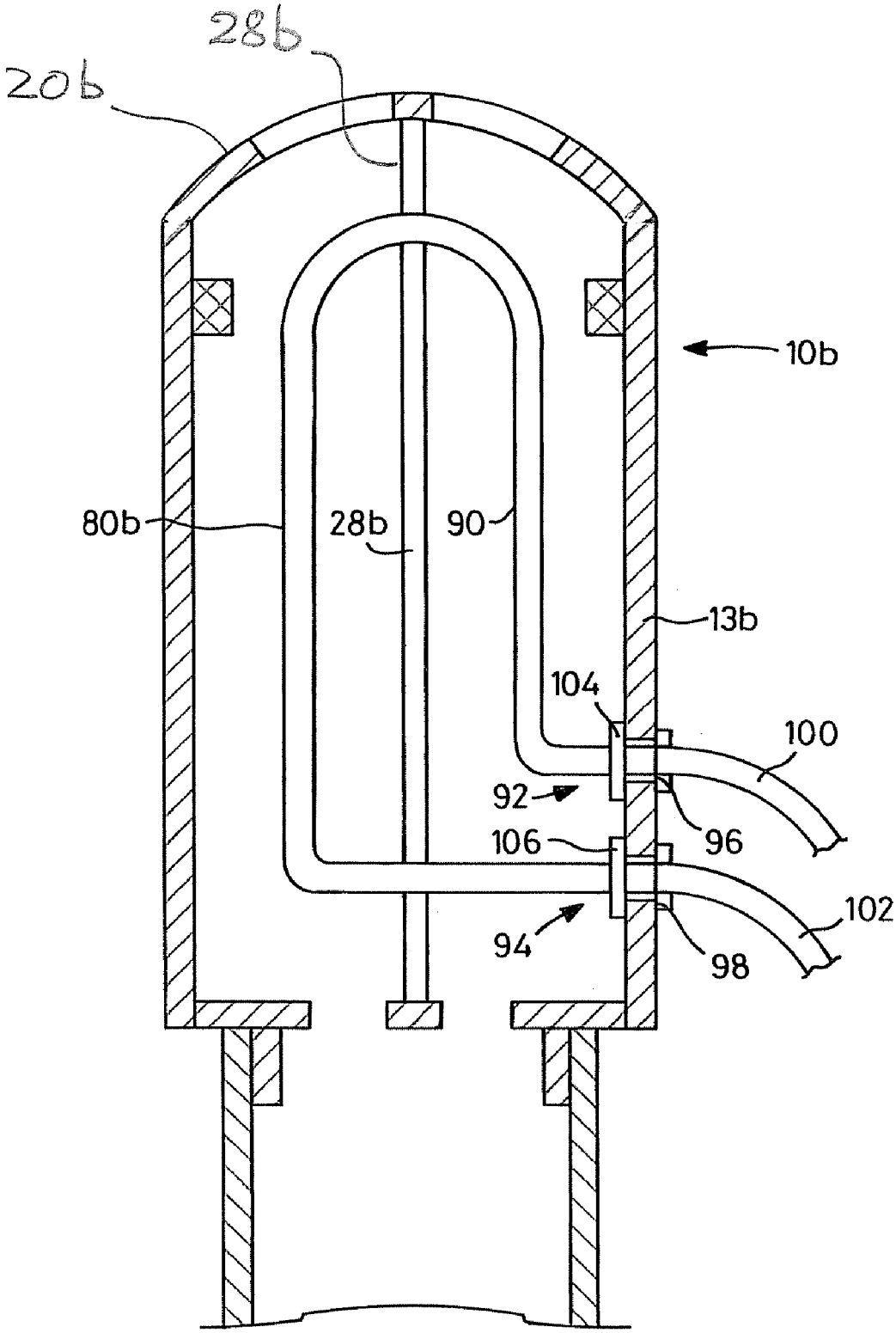

Referring therefore to FIG. 10 in which like components will be identified with like reference numerals with a suffix 'b' added for clarity, a hydronic heating element 80*b* is formed as an open loop 90 with a pair of end fittings 92, 94. The fittings 92, 94 pass through bores 96, 98 in the wall 13*b* for connection to feed pipes 100, 102 connected to the heat source 82.

The fittings 92, 94 are compression fittings with flanges 104, 106 to abut against the inside surface of the wall 13*b*.

A tether 28*b* extends from a bridge 20*b* that is secured to the upper edge of the wall 13*b*. The lower end of the tether 28*b* may be secured to a lower bridge or may be secured to the loop 90. An insulating layer is applied to the interior of wall 13*b* and may have a reflective foil inner surface to minimise heat transfer.

The element 80*b* may be installed within the body 13*b* as a new stand-alone unit that is added to the existing vent pipe or can be retrofitted to an existing vent pipe. In the latter case, the hydronic cable 80*b* is installed by initially boring the holes 96, 98 in the wall 13*b*. The cable 80*b* is inserted from above and the fittings 92, 94 positioned in the holes 96, 98. The fittings are secured with exterior nuts and the pipes 100, 102 connected.

The bridge 20*b* is then installed and tether 28*b* attached to the bridge. The insulating sleeve is inserted.

In each embodiment, therefore, a heat source is provided in the vent pipe to maintain the pipe free of ice blockages. The tether ensures control of ice plugs that may be released as melting occurs. The provision of the double walled housing enables the electrical heating element to be utilised without contact with inflammable gas and by utilising a self-regulating heating element an economical heat source is provided.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

What is claimed is:

1. A vent cap assembly for connection to a vent pipe of a plumbing system, to vent gas to atmosphere, said vent cap having a body defined by a pair of nested pipes of equal length and different diameter and end pieces interconnecting said nested pipes, wherein one nested pipe defines a passageway for gas and the other defines a chamber, said vent cap further including a heating element positioned in said chamber to supply heat to said passageway and thereby inhibit freezing of water vapour in said passageway.

2. A vent cap assembly according to claim 1 wherein each of said end pieces comprises an end cap having upstanding walls to receive respective ends of said pipes.

3. A vent cap assembly according to claim 2 wherein each of said end caps further includes a bridge to extend across said passageway and receive a tether.

4. A vent cap assembly according to claim 1 further including a retainer positioned in said passageway to inhibit egress of a mass of ice from within said passageway.

5. A vent cap assembly according to claim 4 wherein said retainer comprises a tether to retain ice within said passageway as it is melted by said heating element.

6. A vent cap assembly according to claim 5 wherein said tether extends axially along said passageway.

7. A vent cap assembly according to claim 6 wherein said tether is secured to a bridge extending across said passageway.

8. A vent cap assembly according to claim 4 wherein said retainer comprises a lower disk positioned across said passageway to prevent a mass of ice from entering an adjacent pipe.

9. A vent cap assembly according to claim 1 including an insulation layer to inhibit heat transfer from said body.

10. A vent cap assembly according to claim 9 wherein said insulating layer includes a reflective component.

11. A vent cap assembly according to claim 1 wherein said chamber is separated from said passageway by a wall and a heat conductive layer extends across at least a part of a surface of said wall to distribute heat from said heating element to said wall.

12. A vent cap assembly according to claim 11 wherein said heating element is supported by said wall and said heat conductive layer is interposed between said element and said wall.

13. A vent cap assembly according to claim 1 wherein said passageway is defined by an inner one of said pipes and said chamber is defined by a void between said pipes.

14. A vent cap assembly according to claim 13 further comprising a tether extending axially through the interior of said inner pipe to inhibit downward movement of a mass of ice.

15. A vent cap assembly according to claim 13 wherein said heating element is an electric heating element, said electric heating element being wound around said inner pipe within said void.

16. A vent cap assembly according to claim 15 further comprising a layer of conductive material surrounding the outer surface of said inner pipe for dissipating said heat emanating from said heating element over the outer surface of said inner pipe.

17. A vent cap assembly according to claim 16 further comprising a layer of reflective material lining the inner surface of said outer pipe for reflecting said heat radiating from said heating element towards said inner pipe.

18. A vent cap assembly according to claim 13 wherein said void is filled with an insulating material.

19. A vent cap assembly according to claim 18 wherein said insulating material is a urethane foam.

* * * * *